US010925802B2

(12) United States Patent
Matossian

(10) Patent No.: US 10,925,802 B2
(45) Date of Patent: Feb. 23, 2021

(54) MASSAGING ROLLER ASSEMBLY

(71) Applicant: Armand Matossian, Costa Mesa, CA (US)

(72) Inventor: Armand Matossian, Costa Mesa, CA (US)

( * ) Notice: Subject to any disclaimer, the term of this patent is extended or adjusted under 35 U.S.C. 154(b) by 344 days.

(21) Appl. No.: 15/983,242

(22) Filed: May 18, 2018

(65) Prior Publication Data

US 2019/0350799 A1 Nov. 21, 2019

(51) Int. Cl.
*A61H 15/00* (2006.01)

(52) U.S. Cl.
CPC ..... *A61H 15/0092* (2013.01); *A61H 15/00* (2013.01); *A61H 15/0085* (2013.01); *A61H 2015/0014* (2013.01); *A61H 2015/0021* (2013.01); *A61H 2201/0107* (2013.01); *A61H 2201/0157* (2013.01); *A61H 2201/169* (2013.01); *A61H 2201/1645* (2013.01)

(58) Field of Classification Search
CPC ..... A61H 15/0092; A61H 2015/0014; A61H 2205/081; A61H 2201/1645; A61H 2201/0107; A61H 2201/1253; A61H 2201/169; A61H 1/00
See application file for complete search history.

(56) References Cited

U.S. PATENT DOCUMENTS

| | | | | |
|---|---|---|---|---|
| 2,221,785 | A | 11/1940 | Douglas | |
| 3,645,256 | A | 2/1972 | Morrison | |
| 4,712,539 | A | 12/1987 | Kim | |
| 4,832,006 | A | 5/1989 | Kirsch | |
| D475,464 | S | 6/2003 | Chen | |
| 2006/0235343 | A1* | 10/2006 | Fitzmaurice | A61H 15/0092 601/131 |
| 2011/0313333 | A1 | 12/2011 | Nicholson | |
| 2013/0090582 | A1* | 4/2013 | Bertram | A61H 15/0092 601/119 |
| 2013/0158455 | A1 | 6/2013 | Ruschmeyer | |
| 2014/0121075 | A1* | 5/2014 | Brown | A63B 21/026 482/106 |
| 2016/0127693 | A1 | 5/2016 | Chung | |
| 2016/0296415 | A1* | 10/2016 | Cross | A61H 15/0092 |
| 2017/0071817 | A1* | 3/2017 | Sanchez | A61H 15/0092 |
| 2017/0181922 | A1* | 6/2017 | Hogan | A61H 15/0092 |
| 2018/0353370 | A1* | 12/2018 | Liao | A61H 1/00 |

* cited by examiner

*Primary Examiner* — Quang D Thanh
*Assistant Examiner* — Matthew R Moon

(57) ABSTRACT

A massaging roller assembly for relieving aches and pains includes a tube and a plurality of rings. Each ring has an inner diameter that is complementary to an outside diameter of the tube so that the ring is positioned to insert the tube to frictionally couple the ring to the tube. Each ring has a respective outer diameter so that the plurality of rings comprises rings that have a variety of outer diameters. The rings are selectively couplable to the tube to provide a variety of longitudinal cross-sectional profiles. A user is positioned to roll the tube and the rings on a body to massage the body.

12 Claims, 9 Drawing Sheets

MASSAGING ROLLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to roller assemblies and more particularly pertains to a new roller assembly for relieving aches and pains.

BRIEF SUMMARY OF THE INVENTION

An embodiment of the disclosure meets the needs presented above by generally comprising a tube and a plurality of rings. Each ring has an inner diameter that is complementary to an outside diameter of the tube so that the ring is positioned to insert the tube to frictionally couple the ring to the tube. Each ring has a respective outer diameter so that the plurality of rings comprises rings that have a variety of outer diameters. The rings are selectively couplable to the tube to provide a variety of longitudinal cross-sectional profiles. A user is positioned to roll the tube and the rings on a body to massage the body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
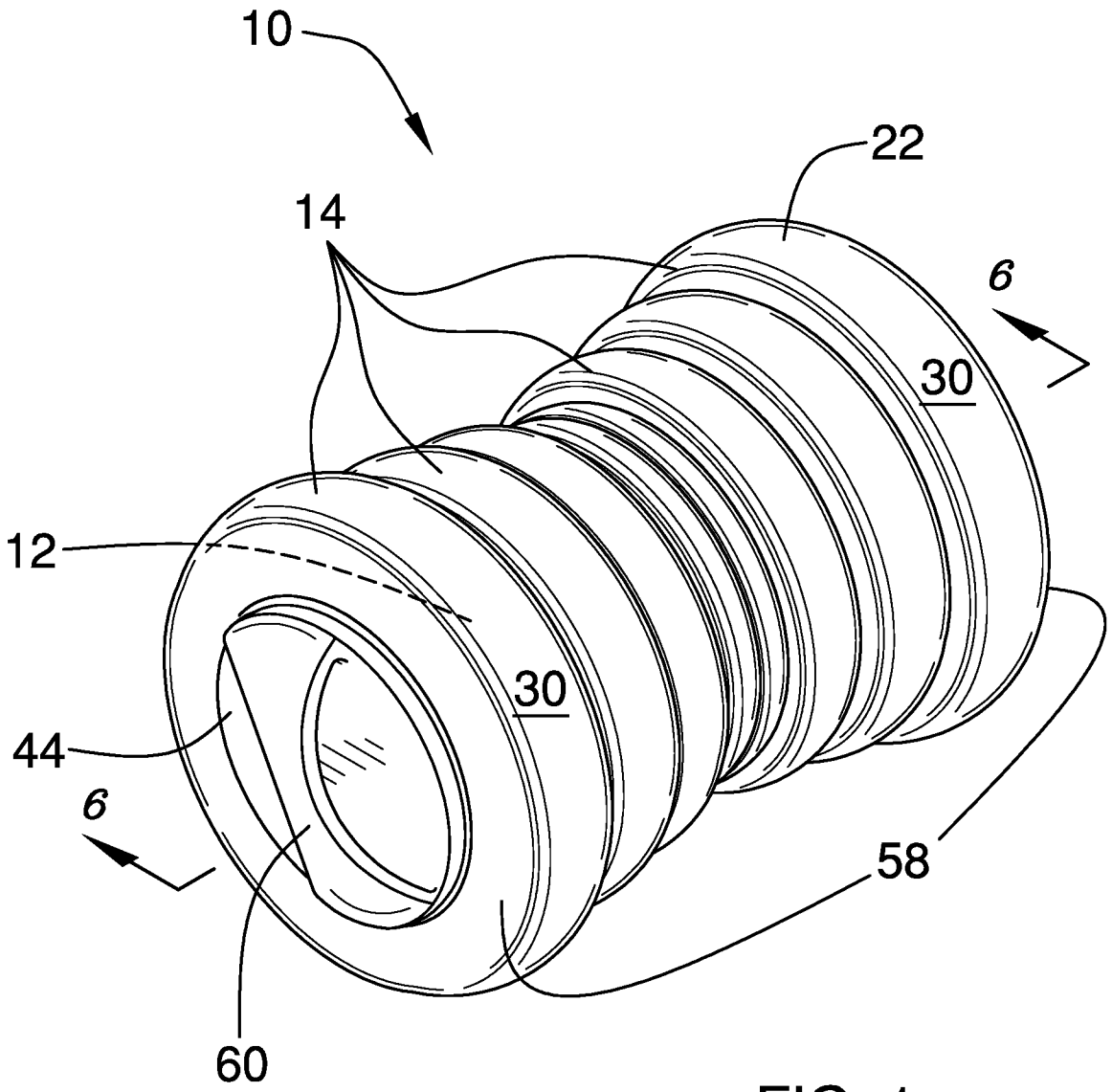
FIG. 1 is an isometric perspective view of a massaging roller assembly according to an embodiment of the disclosure.

With reference now to the drawings, and in particular to FIGS. 1 through 11 thereof, a new roller assembly embodying the principles and concepts of an embodiment of the disclosure and generally designated by the reference numeral 10 will be described.

Figure 2:
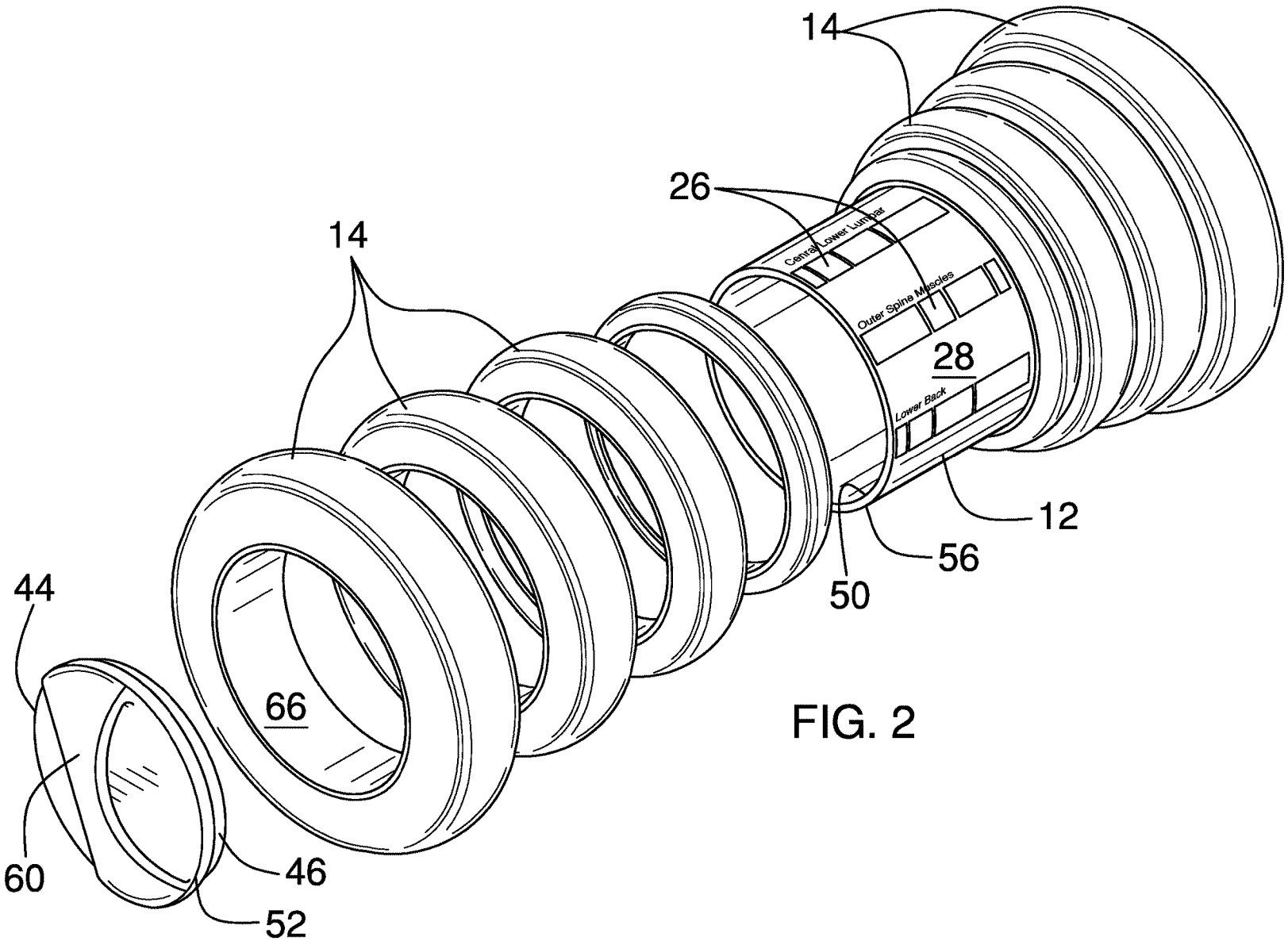
FIG. 2 is an isometric perspective view of an embodiment of the disclosure.
Figures 3, 4:
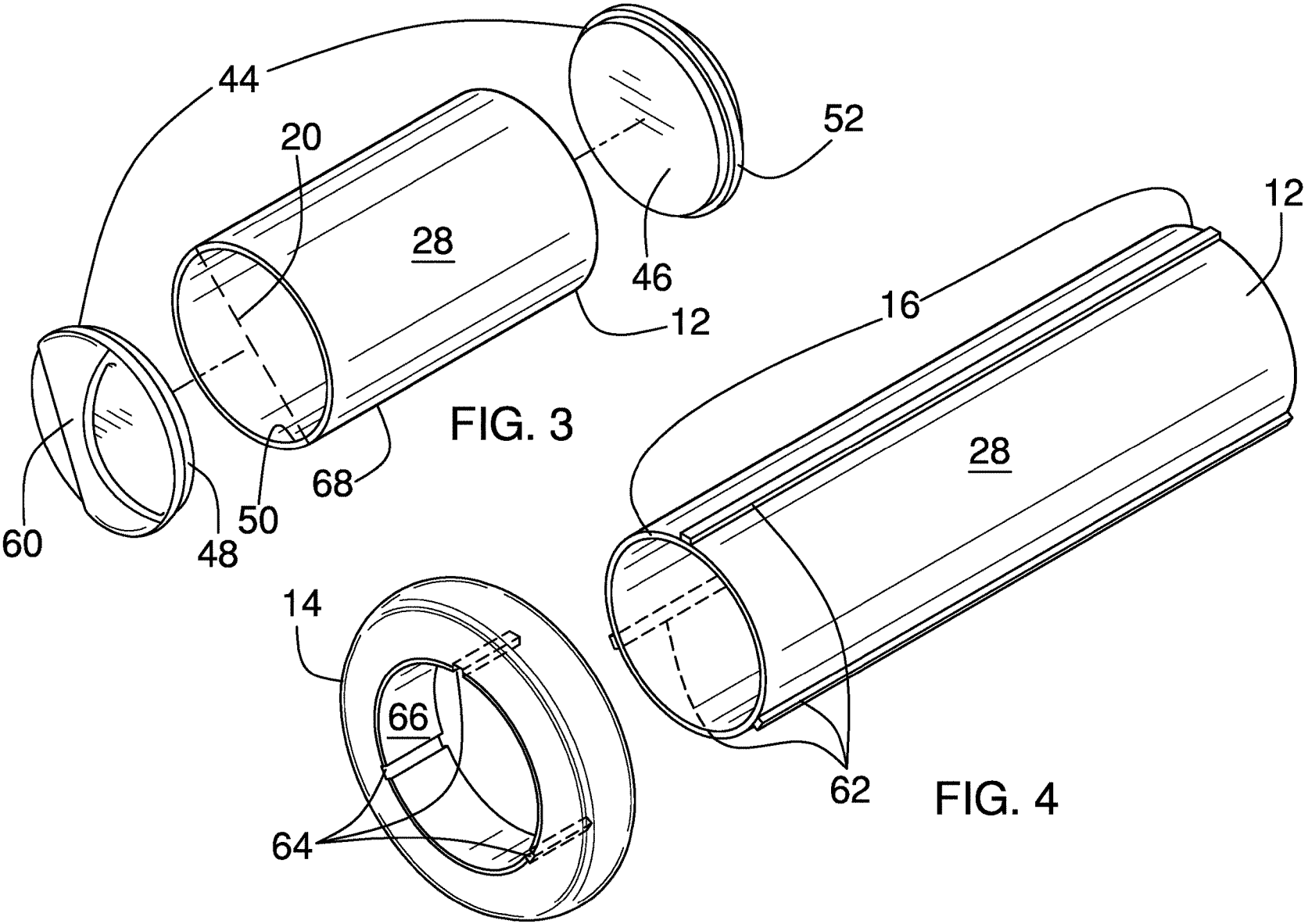
FIG. 3 is an isometric perspective view of an embodiment of the disclosure.
FIG. 4 is an isometric perspective view of an embodiment of the disclosure.
Figure 5:
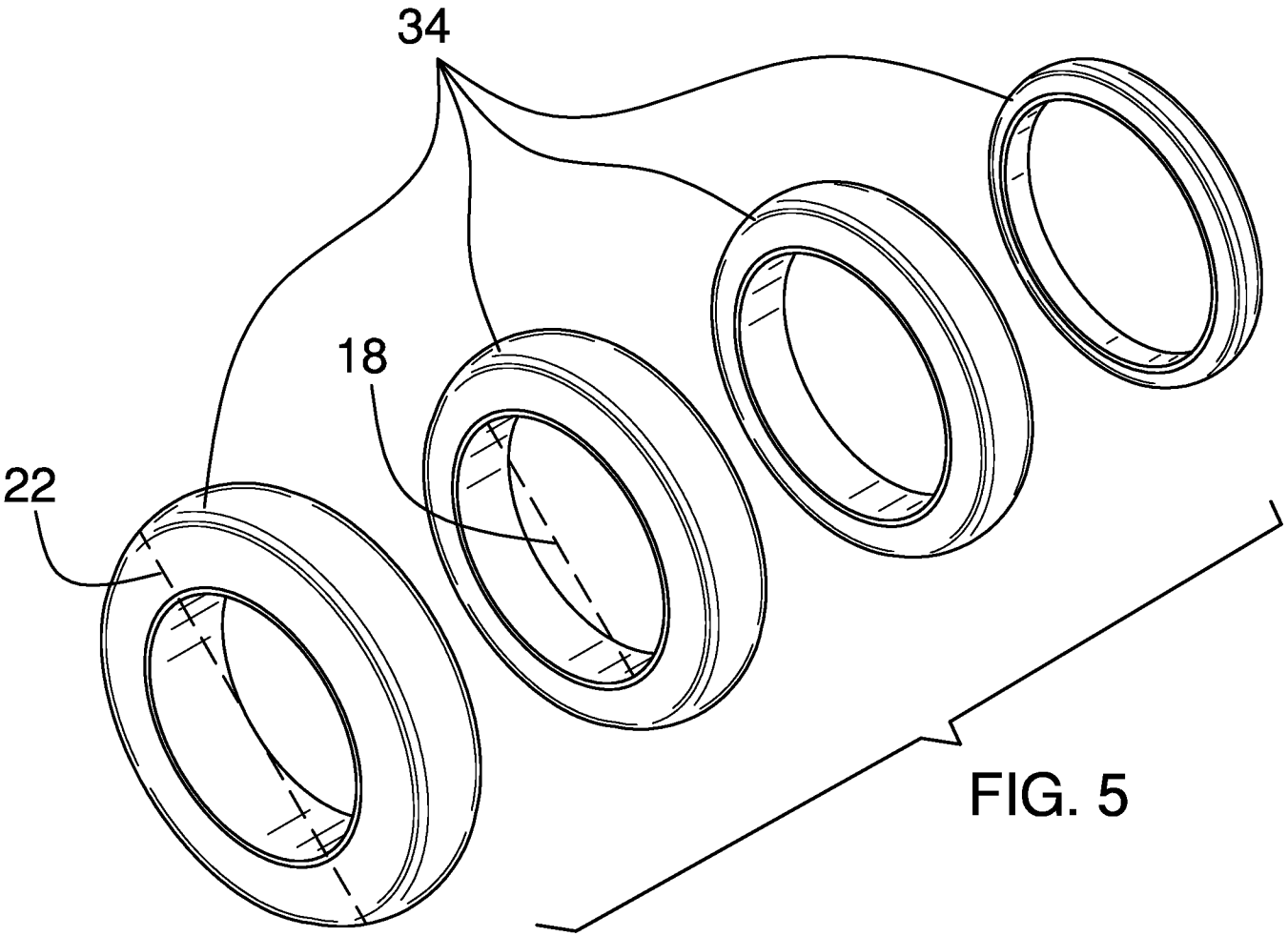
FIG. 5 is an isometric perspective view of an embodiment of the disclosure.
Figure 6:
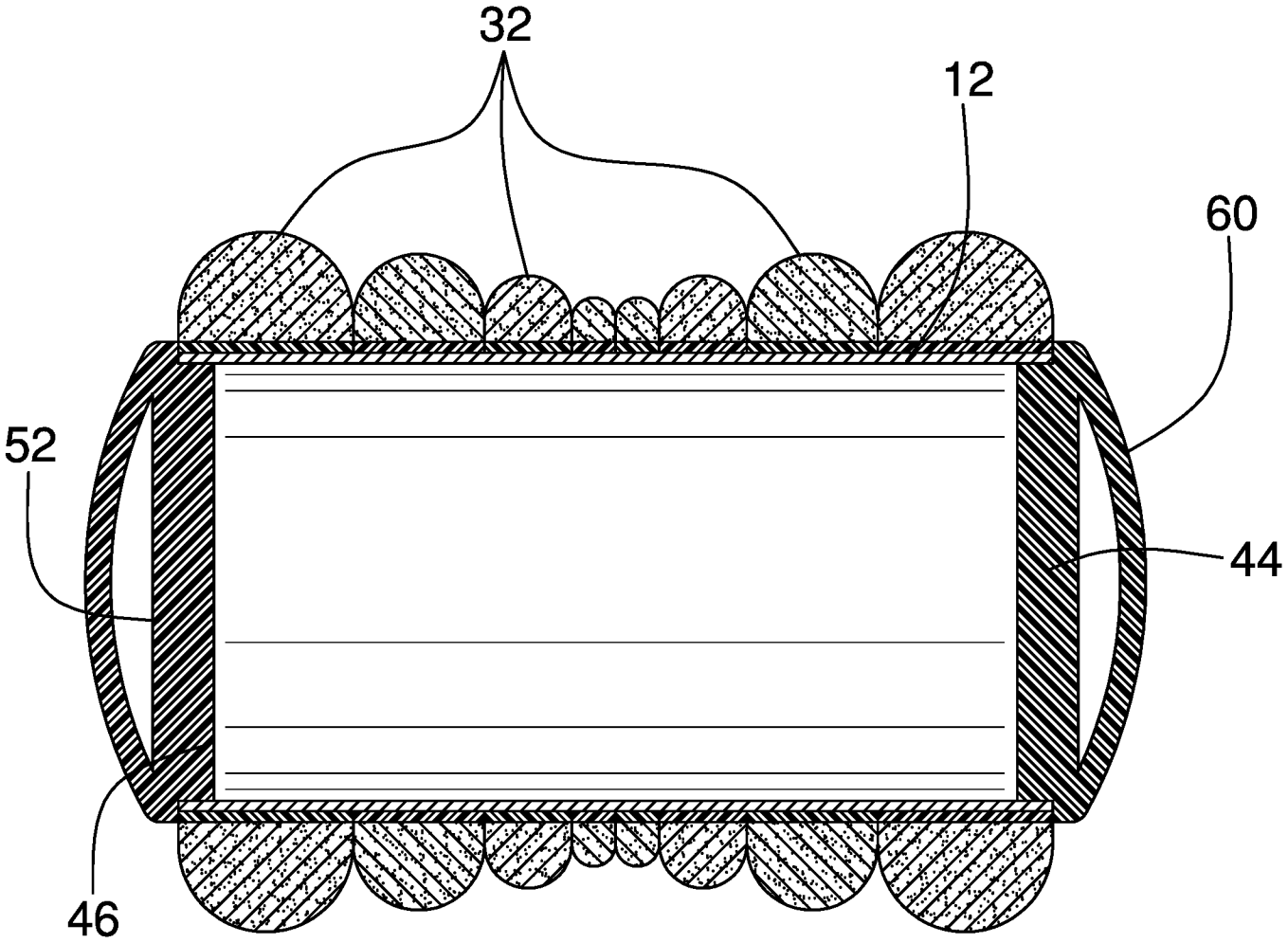
FIG. 6 is a cross-sectional view of an embodiment of the disclosure.

As best illustrated in FIGS. 1 through 11, the massaging roller assembly 10 generally comprises a tube 12 and a plurality of rings 14. The tube 12 has opposing ends 16 that are open, as shown in FIG. 3. The tube 12 may comprise multiple tubes 12 that each have a respective length 68, as shown in FIGS. 3 and 4. Each ring 14 has an inner diameter 18 that is complementary to an outside diameter 20 of the tube 12, as shown in FIG. 2. The ring 14 is positioned to insert the tube 12 to frictionally couple the ring 14 to the tube 12.

Each ring 14 has a respective outer diameter 22 so that the plurality of rings 14 comprises rings 14 that have a variety of outer diameters 22, as shown in FIG. 2. The rings 14 are selectively couplable to the tube 12 to provide a variety of longitudinal cross-sectional profiles. A user is positioned to roll the tube 12 and the rings 14 on a body to massage the body.

Figure 7:
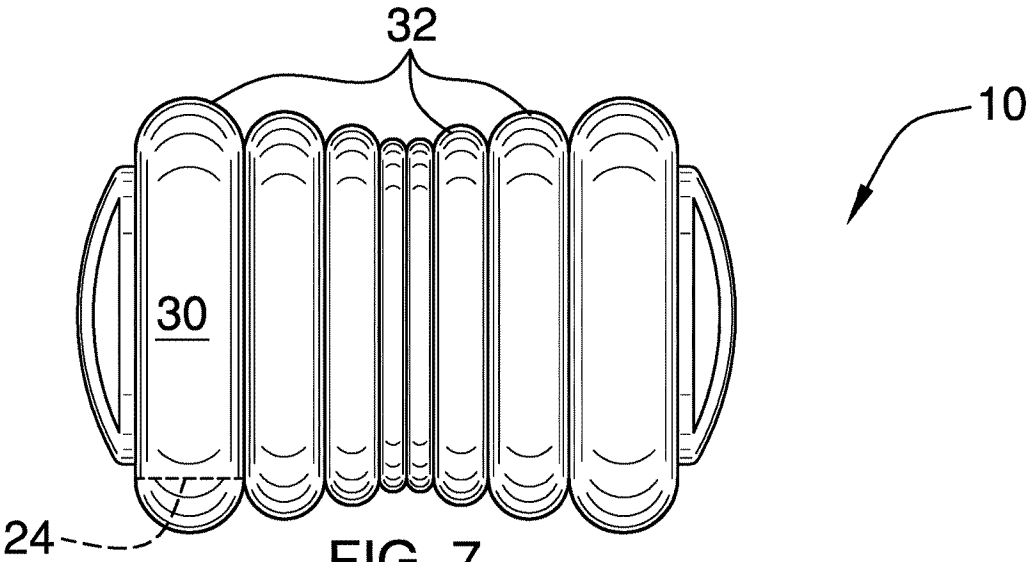
FIG. 7 is a side view of an embodiment of the disclosure.

Each ring 14 has a respective width 24 so that the plurality of rings 14 comprises rings 14 that have a variety of widths 24, as shown in FIG. 7. The rings 14 are selectively couplable to the tube 12 to provide a variety of the longitudinal cross-sectional profiles.

Indicia 26 are positioned on an exterior 28 of the tube 12, as shown in FIG. 2. The indicia 26 indicate placement of the rings 14 on the tube 12 to generate a respective longitudinal cross-sectional profile that is complementary to a region of a back of the body.

Each ring 14 has an outer surface 30. Each outer surface 30 has a respective contour so that the plurality of rings 14 comprises rings 14 that have a variety of contours. The rings 14 are selectively couplable to the tube 12 to provide a variety of the longitudinal cross-sectional profiles. The rings 14 are resilient so that the rings 14 are configured to conform to contours of the body of the user. The rings 14 comprise foam.

Figure 8:
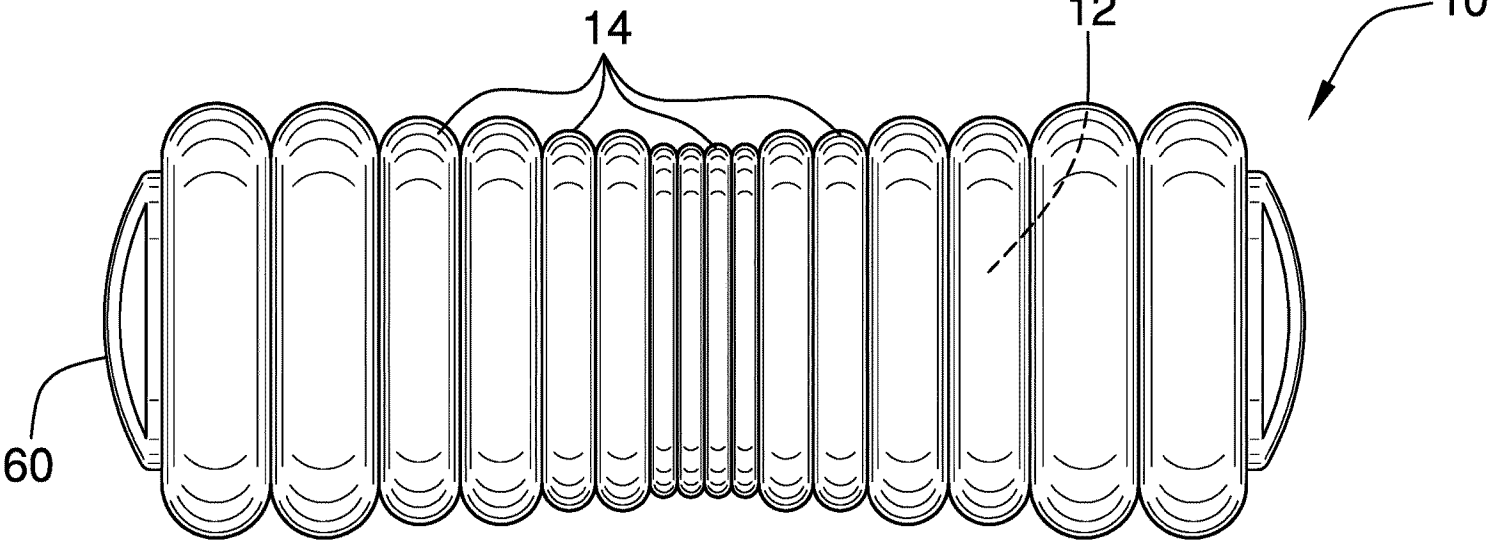
FIG. 8 is a side view of an embodiment of the disclosure.
Figure 9:
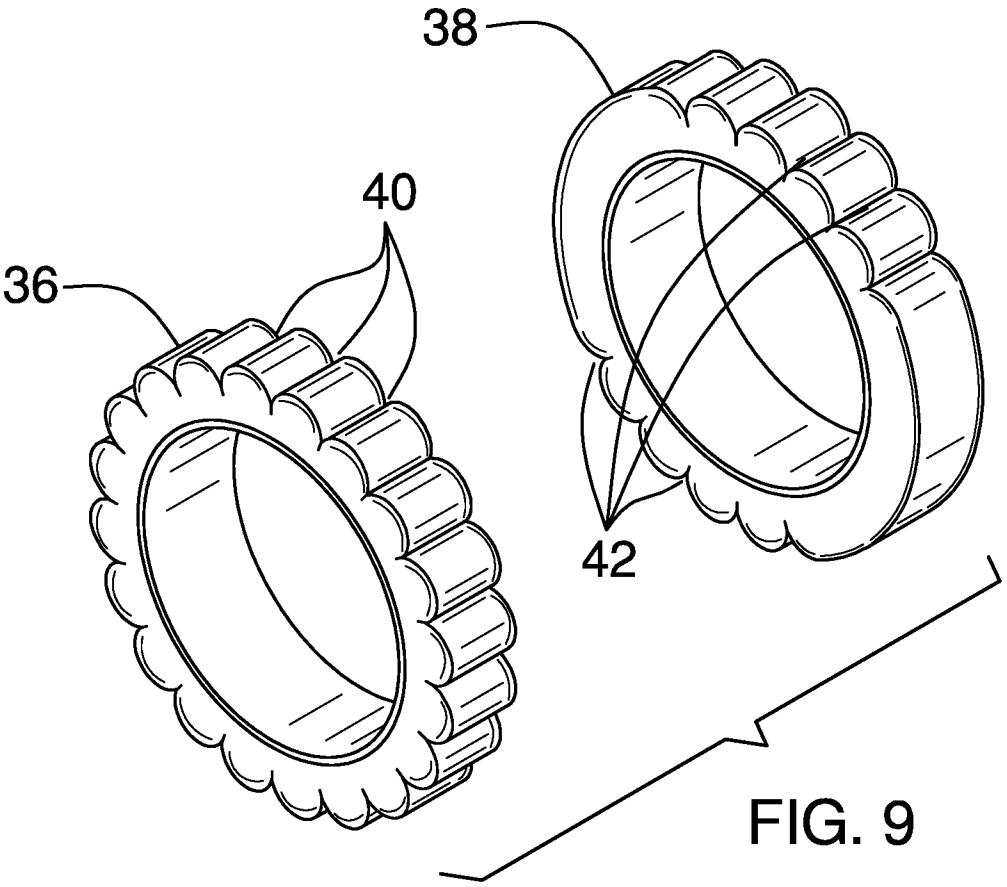
FIG. 9 is an isometric perspective view of an embodiment of the disclosure.

The plurality of rings 14 comprises a first set 32, a second set 34, a third set 36, and a fourth set 38. The outer surface 30 of each ring 14 of the first set 32 is arcuately contoured, as shown in FIG. 8. The outer surface 30 of each ring 14 of the second set 34 is flatly contoured, as shown in FIG. 1. The outer surface 30 of each ring 14 of the third set 36 comprises a plurality of indentations 40 so that the outer surface 30 is knobby, as shown in FIG. 9. The outer surface 30 of each ring 14 of the fourth set 38 comprises a plurality of sets of recesses 42 so that the outer surface 30 is intermittently knobby, as shown in FIG. 9. The plurality of sets of recesses 42 comprises two sets of recesses 42 that are positioned in circumferential opposition on the ring 14 of the fourth set 38.

Each of a pair of caps 44 is selectively couplable to a respective opposing end 16 of the tube 12, as shown in FIG. 3. The caps 44 are circumferentially larger than the tube 12 so that the pair of caps 44 is positioned to couple to the tube 12 to retain the plurality of rings 14 on the tube 12.

Each cap 44 comprises a first disc 46 that has an outer perimeter 48 that is complementary to an inside circumference 50 of the tube 12. The first disc 46 is positioned to be selectively inserted into the respective opposing end 16 of the tube 12. A second disc 52 is coupled to the first disc 46. The second disc 52 has an outside perimeter 54 that is larger than an outside circumference 56 of the tube 12 so that the second disc 52 is positioned to abut a respective opposing endpoint 58 of the plurality of rings 14 to retain the rings 14 on the tube 12.

A handle 60 is coupled to and extends from the second disc 52. The handle 60 is opposingly positioned on the second disc 52 relative to the first disc 46. The handle 60 is positioned to be grasped in digits of a hand of the user to selectively insert the first disc 46 into the respective opposing end 16 of the tube 12.

In another embodiment, as shown in FIG. 4, each of a plurality of ridges 62 is coupled to and extends from the exterior 28 of the tube 12. The ridge 62 extends between the opposing ends 16 of the tube 12. The plurality of ridges 62 comprises three ridges 62 that are evenly spaced around the outside circumference 56 of the tube 12. This embodiment comprises a plurality of sets of channels 64. Each channel 64 of a respective set of channels 64 extends into an associated ring 14 from an inner surface 66 of the associated ring 14. The channels 64 are positioned to insert the ridges 62 as the associated ring 14 is positioned on the tube 12. The ridges 62 are positioned to prevent rotation of the associated ring 14 around the tube 12.

Figure 10:
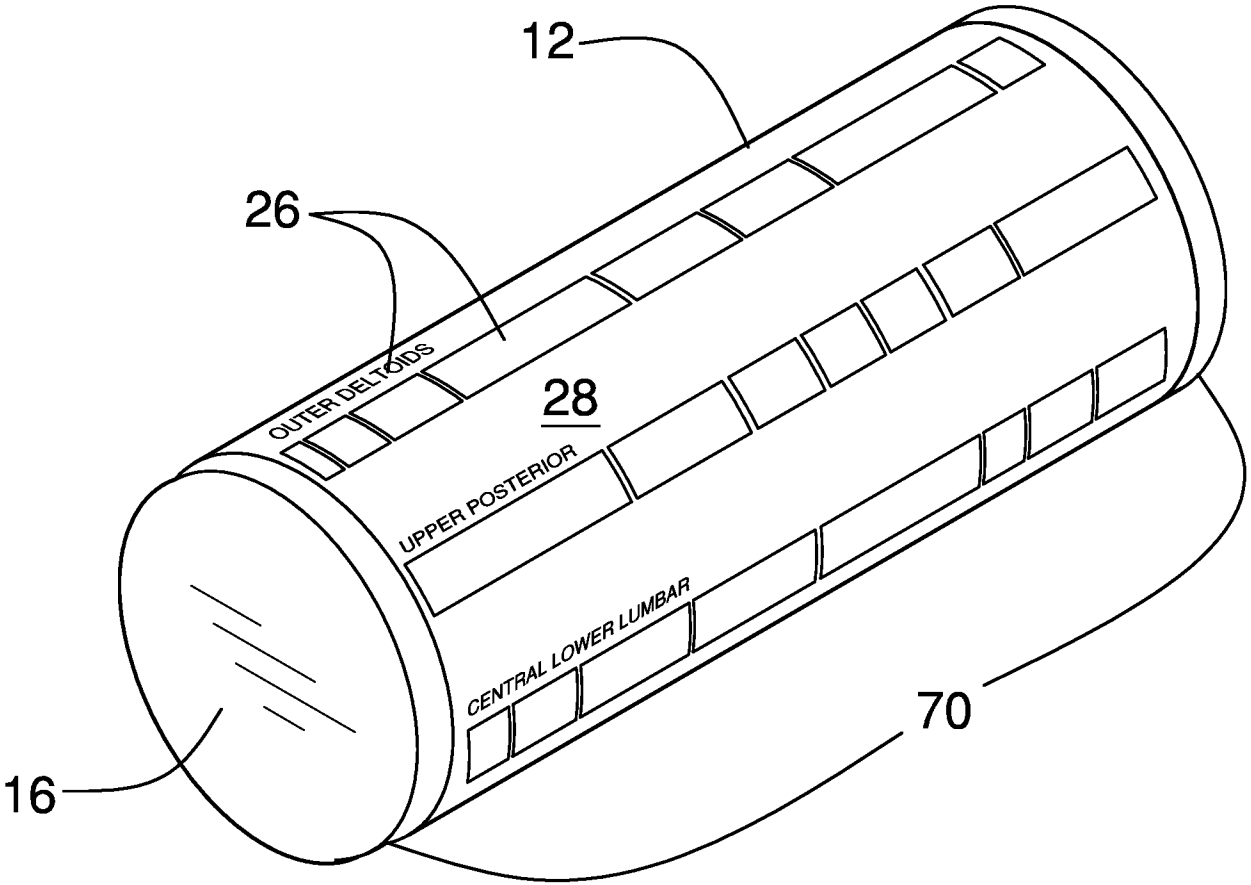
FIG. 10 is an isometric perspective view of an embodiment of the disclosure.
Figure 11:
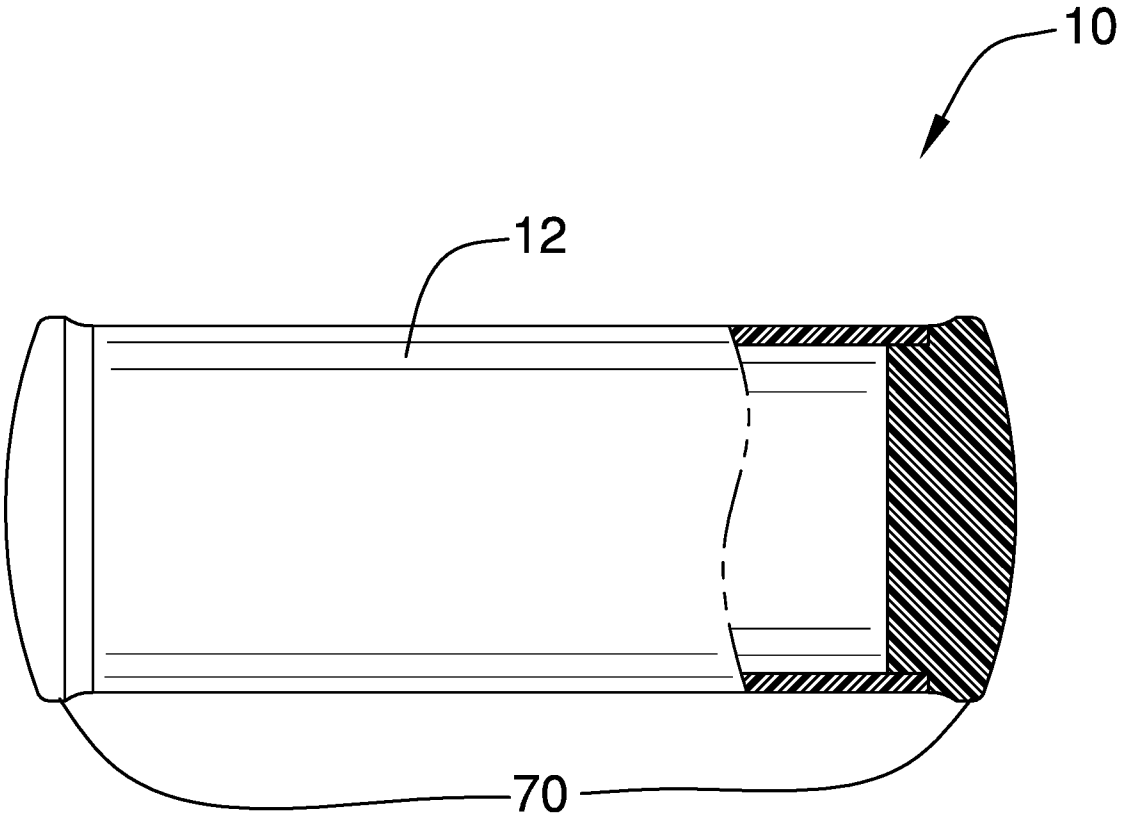
FIG. 11 is a detail view of an embodiment of the disclosure.

In yet another embodiment of the invention, as shown in FIGS. 10 and 11, the tube 12 is solid and comprises foam. As such, the tube 12 is configured to be rolled on the body. Each of a pair of extrusions 70 is coupled to and extends radially from a respective has opposing end 16 of the tube 12. The extrusions 70 comprise foam and are positioned to be compressed to insert the tube 12 into the rings 14. The extrusions 70 are positioned to rebound to retain the rings 14 on the tube 12.

In use, the rings 14 are selectively couplable to the tube 12 to provide the respective longitudinal cross-sectional profile. The user is positioned to roll the tube 12 and the rings 14 on the body to massage the body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A massaging roller assembly comprising:

a tube; and a plurality of rings, each said ring having an inner diameter complementary to an outside diameter of said tube wherein said ring is positioned for inserting said tube for frictionally coupling said ring to said tube, each said ring having a respective outer diameter such that said plurality of rings comprises rings having a variety of outer diameters wherein said rings are selectively couplable to said tube for providing a variety of longitudinal cross-sectional profiles wherein a user is positioned for rolling said tube and said rings on a body for massaging the body, each said ring having a respective width such that said plurality of rings comprises rings having a variety of widths wherein said rings are selectively couplable to said tube for providing a variety of longitudinal cross-sectional profiles; and indicia comprising a plurality of different patterns positioned on an outside circumference of an exterior of said tube on an exterior of said tube for indicating placement of said rings on said tube corresponding to each of the plurality of different patterns for the respective widths of the rings for generating a respective longitudinal cross-sectional profile.

2. The assembly of claim 1, further including each said ring having an outer surface, each said outer surface having a respective contour such that said plurality of rings comprises rings having a variety of contours wherein said rings are selectively couplable to said tube for providing a variety of longitudinal cross-sectional profiles.

3. The assembly of claim 1, further including said rings being resilient such that said rings are configured for conforming to contours of the body of the user.

4. The assembly of claim 3, further including said rings comprising foam.

5. The assembly of claim 2, further including said plurality of rings comprising:

a first set, said outer surface of each said ring of said first set being arcuately contoured;

a second set, said outer surface of each said ring of said second set being flatly contoured;

a third set, said outer surface of each said ring of said third set comprising a plurality of indentations such that said outer surface is knobby; and a fourth set, said outer surface of each said ring of said fourth set comprising a plurality of sets of recesses such that said outer surface is intermittently knobby.

6. The assembly of claim 5, further including said plurality of sets of recesses comprising two said sets of recesses positioned in circumferential opposition on said ring of said fourth set.

7. The assembly of claim 1, further comprising:

said tube having opposing ends, said opposing ends being open; and a pair of caps, each said cap being selectively couplable to a respective said opposing end of said tube, said caps being circumferentially larger than said tube wherein said pair of caps is positioned for coupling to said tube for retaining said plurality of rings on said tube.

8. The assembly of claim 7, further including each said cap comprising:

a first disc having an outer perimeter complementary to an inside circumference of said tube wherein said first disc is positioned for selectively inserting into said respective said opposing end of said tube;

a second disc coupled to said first disc, said second disc having an outside perimeter larger than said outside circumference of said tube wherein said second disc is positioned for abutting a respective opposing endpoint of said plurality of rings for retaining said rings on said tube; and a handle coupled to and extending from said second disc, said handle being opposingly positioned on said second disc relative to said first disc wherein said handle is positioned for grasping in digits of a hand of the user for selectively inserting said first disc into said respective said opposing end of said tube.

9. The assembly of claim 1, further comprising:

a plurality of ridges, each said ridge being coupled to and extending from said exterior of said tube, said ridge extending between opposing ends of said tube; and a plurality of sets of channels, each said channel of a respective said set of channels extending into an associated said ring from an inner surface of said associated said ring wherein said channels are positioned for inserting said ridges as said associated said ring is positioned on said tube wherein said ridges are positioned for preventing rotation of said associated said ring around said tube.

10. The assembly of claim 9, further including said plurality of ridges comprising three said ridges evenly spaced around said outside circumference of said tube.

11. The assembly of claim 1, further comprising:

said tube comprising foam;

a pair of extrusions, each said extrusion being coupled to and extending radially from a respective opposing end of said tube, said extrusions comprising foam wherein each said extrusion is positioned to be compressed for inserting said tube into said rings and wherein said extrusion is positioned for rebounding retaining said rings on said tube.

12. A massaging roller assembly comprising:

a tube, said tube having opposing ends, said opposing ends being open;

a plurality of rings, each said ring having an inner diameter complementary to an outside diameter of said tube wherein said ring is positioned for inserting said tube for frictionally coupling said ring to said tube, each said ring having a respective outer diameter such that said plurality of rings comprises rings having a variety of outer diameters wherein said rings are selectively couplable to said tube for providing a variety of longitudinal cross-sectional profiles wherein a user is positioned for rolling said tube and said rings on a body for massaging the body, each said ring having a respective width such that said plurality of rings comprises rings having a variety of widths wherein said rings are selectively couplable to said tube for providing a variety of longitudinal cross-sectional profiles, each said ring having an outer surface, each said outer surface having a respective contour such that said plurality of rings comprises rings having a variety of contours wherein said rings are selectively couplable to said tube for providing a variety of longitudinal cross-sectional profiles, said rings being resilient such that said rings are configured for conforming to contours of the body of the user, said rings comprising foam, said plurality of rings comprising:

a first set, said outer surface of each said ring of said first set being arcuately contoured, a second set, said outer surface of each said ring of said second set being flatly contoured, a third set, said outer surface of each said ring of said third set comprising a plurality of indentations such that said outer surface is knobby, and a fourth set, said outer surface of each said ring of said fourth set comprising a plurality of sets of recesses such that said outer surface is intermittently knobby, said plurality of sets of recesses comprising two said sets of recesses positioned in circumferential opposition on said ring of said fourth set;

a pair of caps, each said cap being selectively couplable to a respective said opposing end of said tube, said caps being circumferentially larger than said tube wherein said pair of caps is positioned for coupling to said tube for retaining said plurality of rings on said tube, each said cap comprising:

a first disc having an outer perimeter complementary to an inside circumference of said tube wherein said first disc is positioned for selectively inserting into said respective said opposing end of said tube, a second disc coupled to said first disc, said second disc having an outside perimeter larger than an outside circumference of said tube wherein said second disc is positioned for abutting a respective opposing endpoint of said plurality of rings for retaining said rings on said tube, and a handle coupled to and extending from said second disc, said handle being opposingly positioned on said second disc relative to said first disc wherein said handle is positioned for grasping in digits of a hand of the user for selectively inserting said first disc into said respective said opposing end of said tube;

a plurality of ridges, each said ridge being coupled to and extending from an exterior of said tube, said ridge extending between said opposing ends, said plurality of ridges comprising three said ridges evenly spaced around said outside circumference of said tube;

a plurality of sets of channels, each said channel of a respective said set of channels extending into an associated said ring from an inner surface of said associated said ring wherein said channels are positioned for inserting said ridges as said associated said ring is positioned on said tube wherein said ridges are positioned for preventing rotation of said associated said ring around said tube; and indicia comprising a plurality of different patterns positioned circumferentially on said exterior of said tube for indicating placement of said rings on said tube corresponding to each of the plurality of different patterns for the respective widths of the rings for generating a respective longitudinal cross-sectional profile.

* * * * *